US005661372A

United States Patent [19]

Ishimaru et al.

[11] Patent Number: 5,661,372

[45] Date of Patent: Aug. 26, 1997

[54] STROBOSCOPIC INSTRUMENT HAVING A GATE-CONTROLLED-SWITCHING ELEMENT AND A STEP-UP POWER MEANS THEREFOR

[75] Inventors: Toshiaki Ishimaru, Hino; Hiroshi Yamada, Hachioji, both of Japan

[73] Assignee: Olympus Optical Co., Ltd., Tokyo, Japan

[21] Appl. No.: 429,200

[22] Filed: Apr. 26, 1995

[30] Foreign Application Priority Data

May 2, 1994 [JP] Japan ..... 6-093438

[51] Int. Cl.[6] ..... H05B 37/00; H05B 41/00; H05B 41/32

[52] U.S. Cl. ..... 315/241 P; 315/241 S; 315/241 R; 396/205; 396/206

[58] Field of Search ..... 315/241 S, 241 P, 315/241 R; 354/145.1, 416; 396/205, 206

[56] References Cited

U.S. PATENT DOCUMENTS 3,644,818 2/1972 Paget ..... 315/241 S X

FOREIGN PATENT DOCUMENTS 64-17033 1/1989 Japan .
4-96721 8/1992 Japan .
6-302389 10/1994 Japan .

*Primary Examiner*—Robert Pascal
*Assistant Examiner*—Arnold Kinkead
*Attorney, Agent, or Firm*—Louis Weinstein

[57] ABSTRACT

A stroboscopic instrument is constructed of a gate-controlled switching element forming a discharge loop that is connected in series with a discharge lamp and main capacitor for storing charge that causes the discharge lamp to flash. The stroboscopic instrument further comprises: a stroboscopic flashing control circuit for controlling the operation of stroboscopic flashing; a low-voltage power supply that has an output voltage lower than the driving voltages of the stroboscopic flashing control circuit and the gate-controlled switching element; a first constant voltage regulator for stepping up the voltage of the low-voltage power supply up to the driving voltage of the stroboscopic flashing control circuit; and a second constant voltage regulator for stepping up the voltage of the low-voltage power supply or the output voltage of the first constant voltage regulator up to the driving voltage of the gate-controlled switching element.

11 Claims, 18 Drawing Sheets

CROSS SECTION

CIRCUIT SCHEMATIC FOR P-MCT

STROBOSCOPIC INSTRUMENT HAVING A GATE-CONTROLLED-SWITCHING ELEMENT AND A STEP-UP POWER MEANS THEREFOR

BACKGROUND OF THE INVENTION

1. Field of the Invention

The present invention relates to a stroboscopic instrument, and in particular to a stroboscopic instrument having a gate-controlled switching element.

2. Related Art Statement

Known as an element for controlling flashing of light in recent camera stroboscopes is a gate-controlled switching element such as IGBT (Insulated Gate Bipolar Transistor). For example, Japanese Patent Application Laid-open No. Sho-64-17033 discloses a stroboscope that employs an IGBT wherein the IGBT is turned on in response to a flash command trigger signal and turned off in response to a flash end command.

The prior art disclosed in Patent Application No. Sho-64-17033 requires a power supply for controlling the gate of the switching element, thereby resulting in added cost and needing extra space.

To resolve such problems, Japanese Utility Model Application No. Hei-4-96721 has proposed an electronic flashing device wherein its main capacitor feeds beforehand voltage to the control terminal of a switching element only while the power switch is on.

Japanese Patent Application Laid-open No. Hei 6-302389 has disclosed a newly developed low-voltage gate-drive type switching element which is assuredly triggered by a gate voltage ranging from 4 volts to 8 volts. Such a switching element can be directly driven by a relatively low voltage power supply that is shared with a control circuit.

In the techniques proposed by the above cited Patent Application 64-17033 and Utility Model Application 4-96721, however, a high voltage from a stroboscope charging circuit is directly applied to a gate-controlled switching element to control it. Since the voltage of the high voltage stroboscope charging circuit is used, its circuit configuration is complicated, leading to a bulky design. Furthermore, since the switching element itself has to withstand a high voltage, the device is inevitably costly and bulky in size.

In the technique disclosed in the above cited Patent Application 6-302389, the above-mentioned high-voltage switching element is dispensed with, and a relatively low voltage power supply is used to control the switching element. This technique is particularly useful in a stroboscope which is operated on a battery power supply of about 6 volts (for example, two 3-volt batteries in series). Today, however, cameras that are operated on a lower voltage power supply as low as 3 volts, for example, are increasing in use. The above technique is difficult to implement in such low-voltage driven cameras.

When the gate-controlled switching element of which gate control voltage is 4 to 8 volts is mounted on the stroboscope with a low-voltage power supply as low as about 3 volts, the switching element is accompanied by the following inconveniences.

Namely, a low-voltage power supply as low as 3 volts cannot directly drive the low-voltage driving switching element (its gate control voltage from 4 volts to 8 volts). When the output of the stroboscope charging circuit in the stroboscope is also used as a control voltage for the switching element, the following problems will arise.

1) An increased power consumption shortens the life of the low-voltage power supply.

2) The output voltage of the low-voltage power supply is substantially reduced when a sufficient current margin is not assured during stroboscope charging.

OBJECTS AND SUMMARY OF THE INVENTION

It is a first object of the present invention to provide a compact stroboscopic instrument that accurately performs stroboscopic flashing without imposing increased power consumption on a low-voltage power supply.

It is a second object of the present invention to provide a compact stroboscopic instrument that minimizes voltage drop in a battery during stroboscope charging sessions.

It is a third object of the present invention to provide a stroboscopic instrument that performs flashing control employing a gate-controlled switching element of low-voltage gate drive type, without the need for a complicated circuit or a high-voltage switching element.

The stroboscopic instrument according to the present invention having a gate-controlled switching element forming a discharge loop that is connected in series with a discharge lamp and main capacitor for storing charge that causes the discharge lamp to flash comprises:

stroboscopic flashing control means for controlling the operation of stroboscopic flashing;

a low-voltage power supply that provides a voltage lower than the driving voltages of the stroboscopic flashing control means and the gate-controlled switching element;

a first constant voltage regulator for stepping up the voltage of the low-voltage power supply up to the driving voltage of the stroboscopic flashing control means; and a second constant voltage regulator for stepping up the voltage of the low-voltage power supply or the output voltage of the first constant voltage regulator up to the driving voltage of the gate-controlled switching element.

These as well as other objects and advantages of the present invention will become further apparent from the following detailed explanation.

DETAILED DESCRIPTION OF THE PREFERRED EMBODIMENTS

Referring now the drawings, the embodiments of the present invention are discussed.

Figure 1:
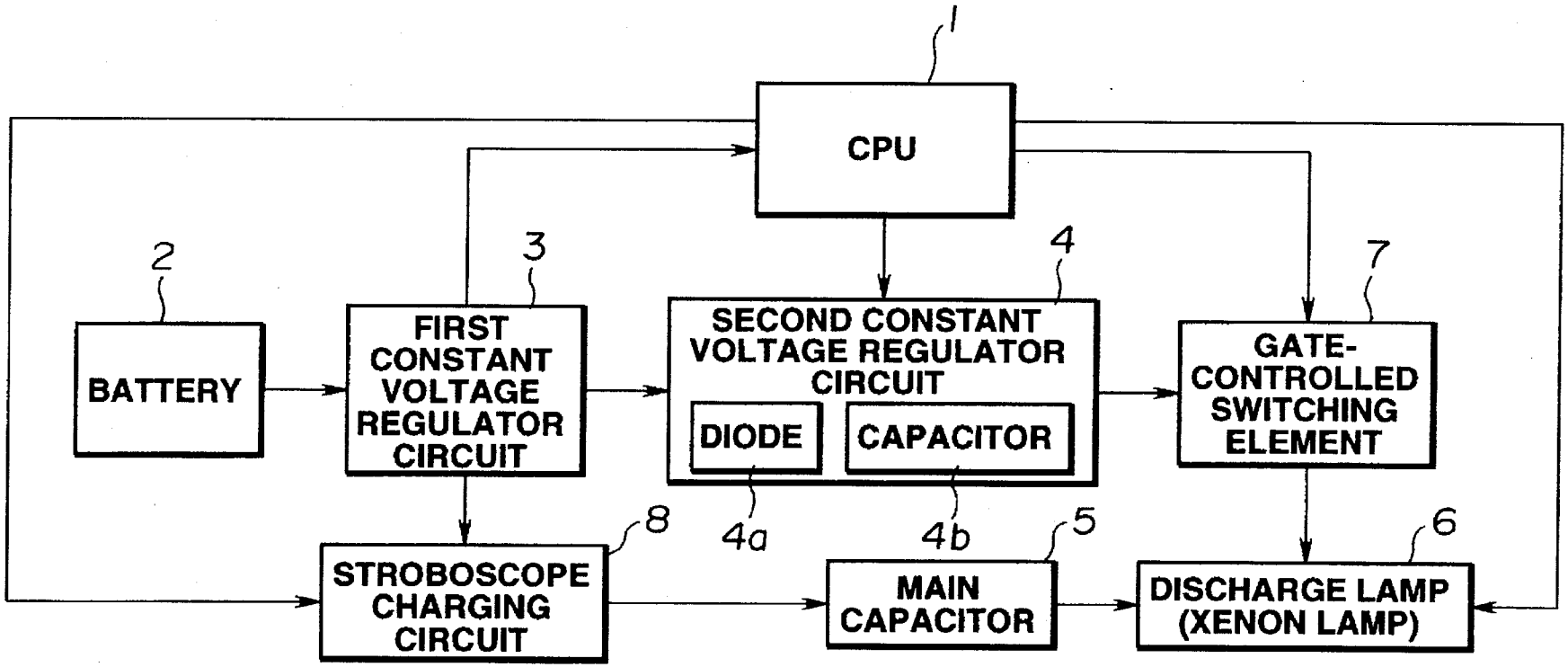
FIG. 1 is a block diagram showing the basic structure of a first embodiment of the stroboscopic instrument according to the present invention.

FIG. 1 is a block diagram showing the basic structure of the first embodiment of the stroboscopic instrument according to the present invention.

As shown, the stroboscopic instrument comprises a battery 2 disposed internally to or externally to the stroboscopic instrument, a first constant voltage regulator circuit 3 for generating a first regulated voltage from the output voltage of the battery 2, CPU 1 supplied with the first regulated voltage for controlling at least the stroboscopic instrument, and a second constant voltage regulator circuit 4, under the control of CPU 1, for generating a second regulated voltage which is approximately an integer multiple of the first regulated voltage based on the first regulated voltage generated by the first constant voltage regulator circuit 3. The second constant voltage regulator circuit 4 comprises a diode 4*a* and a capacitor 4*b*.

The above embodiment of the stroboscopic instrument further comprises main capacitor 5 for storing charge required to cause a stroboscopic discharge lamp 6 (hereinafter referred to as xenon lamp or Xe lamp) to flash, a gate-controlled switching element 7 connected in series with the xenon lamp 6 in the discharge loop of the main capacitor 5, and a stroboscope charging circuit 8, supplied with the first regulated voltage by the first regulator circuit 3, for charging the main capacitor 5 under the control of CPU 1.

The gate-controlled switching element 7 is controlled with its gate supplied with the second regulated voltage provided by the second constant voltage regulator circuit 4, and the gate-controlled switching circuit 7 in turn controls the flashing operation of the xenon lamp 6 under the control of CPU 1.

Figure 2:
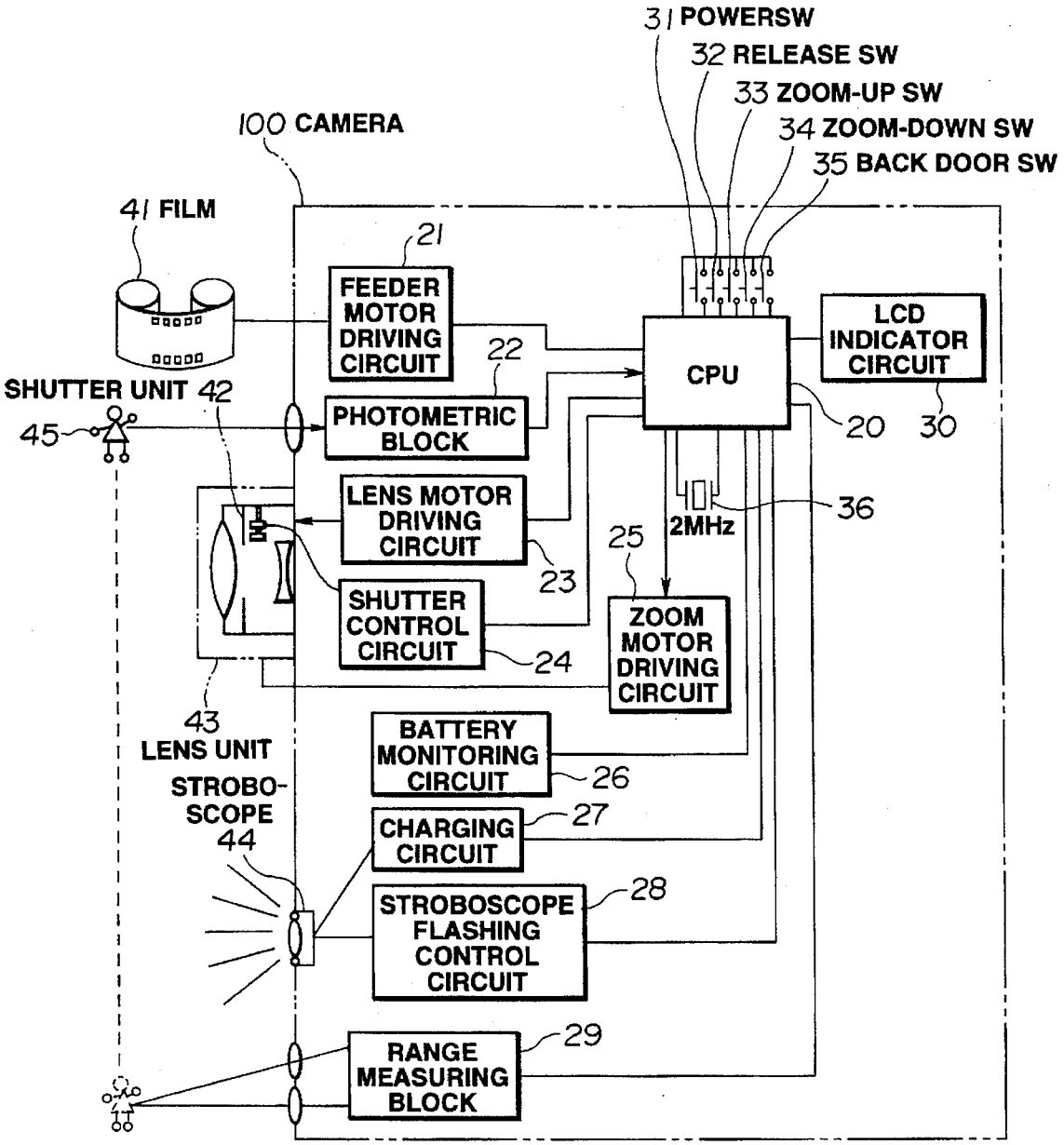
FIG. 2 is a block diagram showing the basic structure of the camera into which the first embodiment of the stroboscopic instrument is incorporated.

FIG. 2 is a block diagram showing the major structure of the camera to which the first embodiment of the stroboscopic instrument is incorporated.

The camera to which the stroboscopic instrument according to the present invention is applicable is of the autofocusing, zoom lens type. CPU 20 controls each block inside a camera 100. Connected to CPU 20 are a power switch (power SW) 31, a release switch (release SW) 32, a zoom-up switch (zoom-up SW) 33, a zoom-down switch (zoom-down SW) 34, and a back door switch (back door SW) 35 which is set to on or off in a manner that is interlocked with the open/close operation of a back door (not shown). In response to the operation of the above switches, CPU 20 controls the camera accordingly.

Furthermore connected to CPU 20 are a feeder motor driving circuit 21 for controlling the feeding of a film 41, a photometric block 22 for photometering an object 45, a lens motor driving circuit 23 for driving and controlling a lens unit 43, a zoom motor driving circuit 25, a shutter control circuit 24 for driving and controlling a shutter unit 42, a battery monitoring circuit 26 for monitoring the built-in battery 2, a charging circuit 27 for flashing the xenon lamp 6 in a stroboscope 44, a stroboscopic flashing control circuit 28, a range measuring block 29 for measuring range to the object 45, and a liquid crystal display (LCD) indicator circuit 30 for displaying the state of the battery 2 and a frame number.

The operation of each block in the camera 100 is now discussed.

When either the zoom-up switch 33 or the zoom-down switch 34 is operated, the zoom lens in the zoom unit 43 is driven by the zoom motor driving circuit 25, and the stroboscope 44 is charged by the charging circuit 27. When the back door is closed, the film 41 is advanced.

When the release switch 32 is on, the photometering block 22 and the range measuring block 29 detect luminance of and range to the object 45, respectively. The lens motor driving circuit 23 drives a photographic lens in the lens unit 43. The shutter control circuit 24 controls the shutter unit 42 at the shutter speed in accordance with luminance.

When a stroboscopic flashing is required, the stroboscopic flashing control circuit 28 causes the stroboscope 44 to flash. When any of the power switch 31, the release switch 32, the zoom-up switch 33, the zoom-down switch 34 and the back door switch 35 is operated or when the battery 2 (FIG. 2) is mounted, the battery monitoring circuit 26 checks the battery 2. When the voltage of the battery 2 drops, the camera is locked. When the battery 2 has sufficient power, the camera performs as commanded by any switch.

Figure 3:
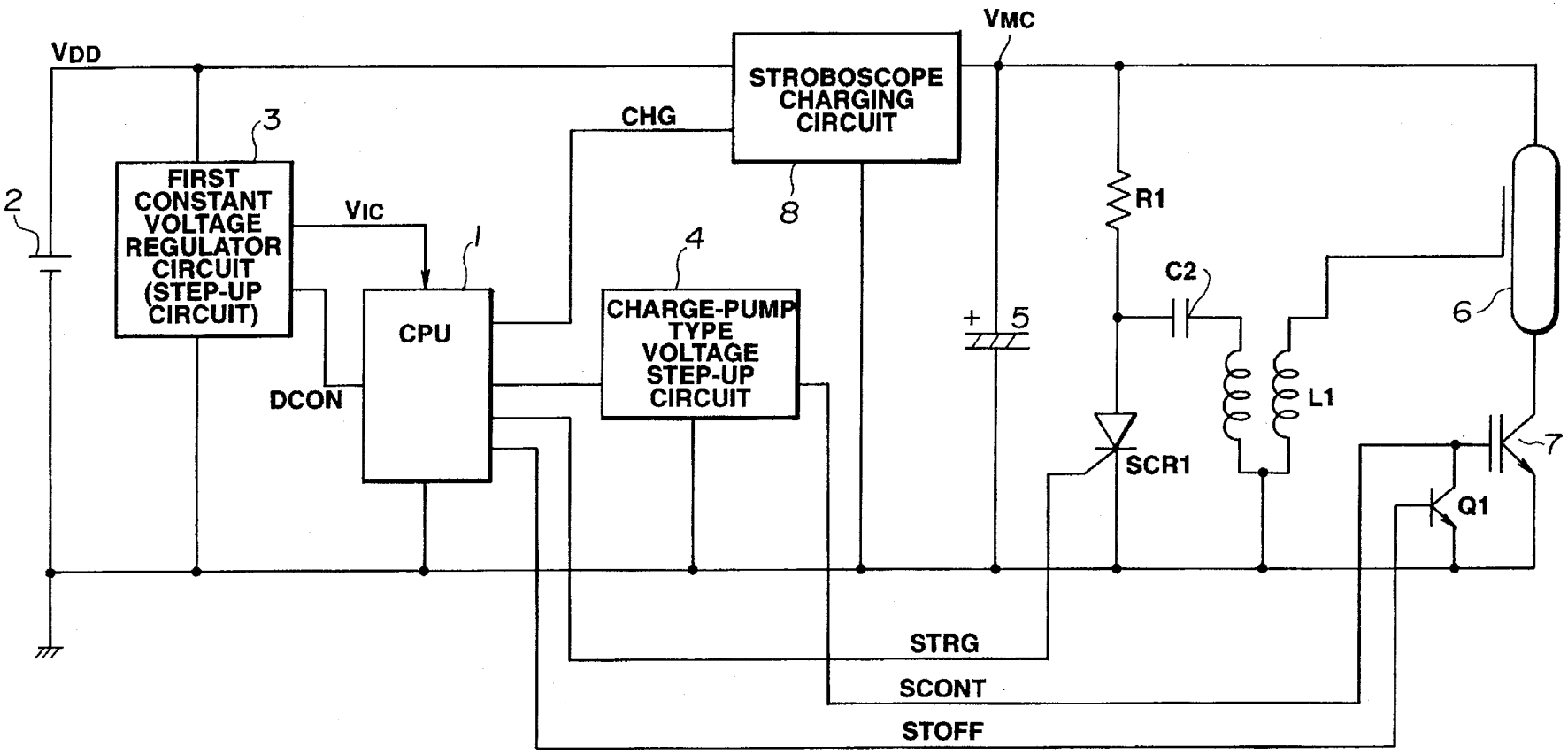
FIG. 3 is a block diagram showing the detailed structure of the first embodiment of the stroboscopic instrument of FIG. 1.

FIG. 3 is the block diagram showing further in detail the embodiment of the stroboscopic instrument of FIG. 1.

The first constant voltage regulator 3 converts the supply voltage of the battery 2, VDD, into a regulated voltage VIC (first regulated voltage) for IC circuit including CPU 1. The first regulated voltage is supplied to CPU 1. CPU 1 supplies a signal DCON to the first constant voltage regulator 3 to control it in its voltage regulation operation for the output voltage VIC in an on/off manner. CPU 1 outputs a signal CHG from its CHG terminal to control the stroboscope charging circuit 8 so that the main capacitor 5 is charged by a high voltage VMC. The high voltage VMC is also applied to a thyristor SCR 1 and a capacitor C 2 through a resistor R 1 by the stroboscope charging circuit 8.

The other electrode of the capacitor C 2 is connected to a trigger transformer L 1, which, in turn, is connected to ground (GND) and the xenon lamp 6. The control electrode of SCR 1 is connected to a terminal STRG on CPU 1. When a signal STRG from the STRG terminal is on, the xenon lamp 6 flashes.

The xenon lamp 6 is connected in series with the gate-controlled switching element (IGBT) 7. The gate electrode of IGBT 7 is connected to both the terminal SCONT of the second constant voltage regulator 4 constructed of the voltage step-up circuit of charge pump type and a transistor Q1 for shorting the gate electrode of IGBT 7 to GND. The base of the transistor Q1 is connected to the terminal STOFF on CPU 1.

The operation of the stroboscopic instrument is now discussed in accordance with the flow of (voltage) signals.

Prior to the flashing of the xenon lamp 6, the signal STOFF from the STOFF terminal of CPU 1 is set to "L" (low) level and the gate of IGBT 7 is supplied with a voltage between 4 and 8 volts from the output terminal SCONT of the second constant voltage regulator 4 (step-up circuit of charge pump type). Therefore, IGBT 7 remains conductive.

Upon receiving the signal from the STRG terminal of CPU 1, the thyristor SCR 1 causes the capacitor 2 to discharge, generating a high voltage in the secondary coil of the transformer L 1, and turning the xenon lamp 6 conductive to flash. After an arbitrarily set duration of time, CPU 1 drives the signal STOFF to "H" (high) level, causing the transistor Q1 to be conductive, shorting the gate of IGBT 7 to GND, and ending the flashing of the xenon lamp 6.

Figure 4:
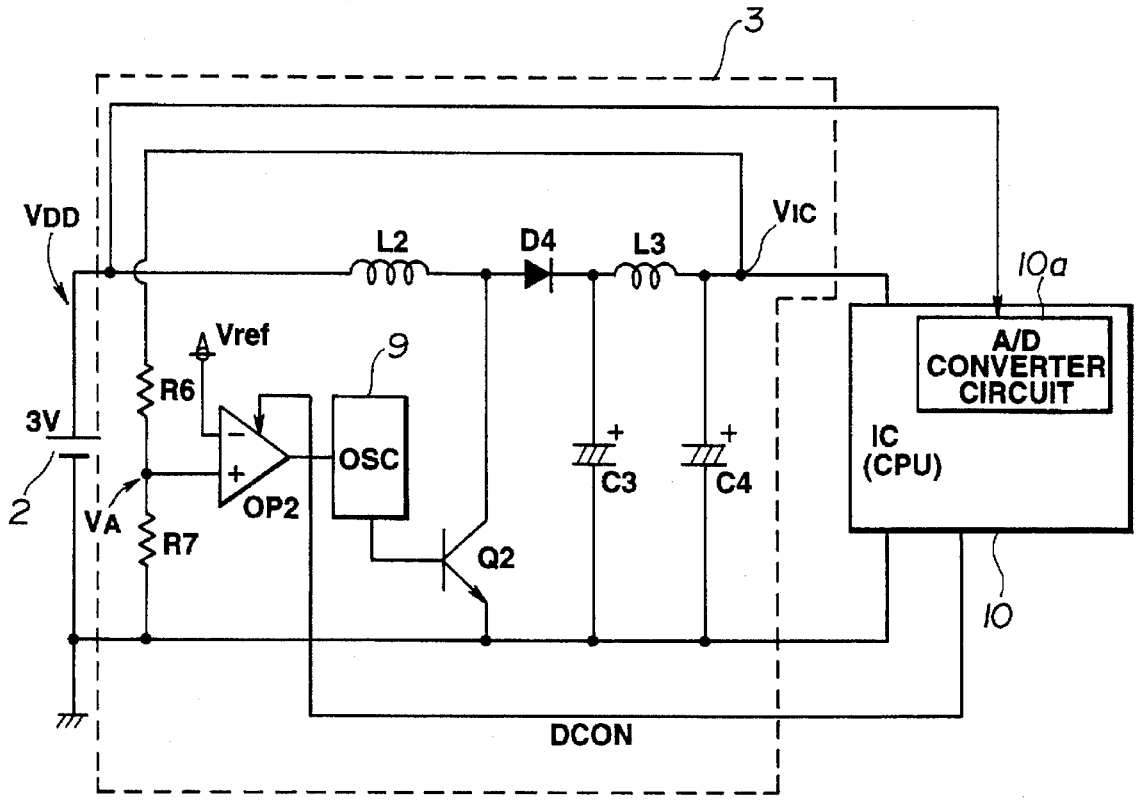
FIG. 4 is a schematic diagram showing the first constant voltage regulator and its associated circuit of the first embodiment of the stroboscopic instrument.

FIG. 4 is a schematic diagram showing in detail the first constant voltage regulator circuit 3 of this embodiment.

The camera into which this embodiment is incorporated is provided with a built-in battery 2 of supply voltage VDD=3 volts. During motor operation or stroboscope charging, the supply voltage VDD drops through the battery internal resistance and power consumption. The first constant voltage regulator circuit 3 is designed to guarantee that the ICs including the CPU 1 operate normally by stepping up the supply voltage even when the voltage of the battery drops. In this embodiment, the built-in battery is of a 3-volt type. The battery is not limited to this type. Alternatively, a battery lower than 3 volts may be employed. The principle of this embodiment effectively works even on a 2-volt or 1.5-volt battery.

The operation of the above arrangement is now discussed.

The voltage VIC for IC 10 including CPU 1 is a voltage divided by a voltage divider constructed of resistors R 6 and R 7. A voltage VA at the middle of the voltage divider is compared with a reference voltage Vref at a comparator OP2. When CPU 1 (IC 10) outputs a DCON signal indicative of DC/DC on, the comparator OP 2 is activated.

When VA<Vref, the comparator OP 2 gives its output, causing an oscillator circuit (OSC) 9 to operate, thereby performing a voltage step-up operation through the network of a transistor Q 2, a diode D 4, and a capacitor C 3 in a chopper fashion. A transformer (i.e., inductor) L 3 and a capacitor C 4 absorb noise spikes.

In this embodiment, the voltage VIC for IC 10 is see to 3.5 volts by selecting properly the magnitude of the reference voltage Vref and the ratio of the dividing resistors R 6 and R 7.

Figure 5:
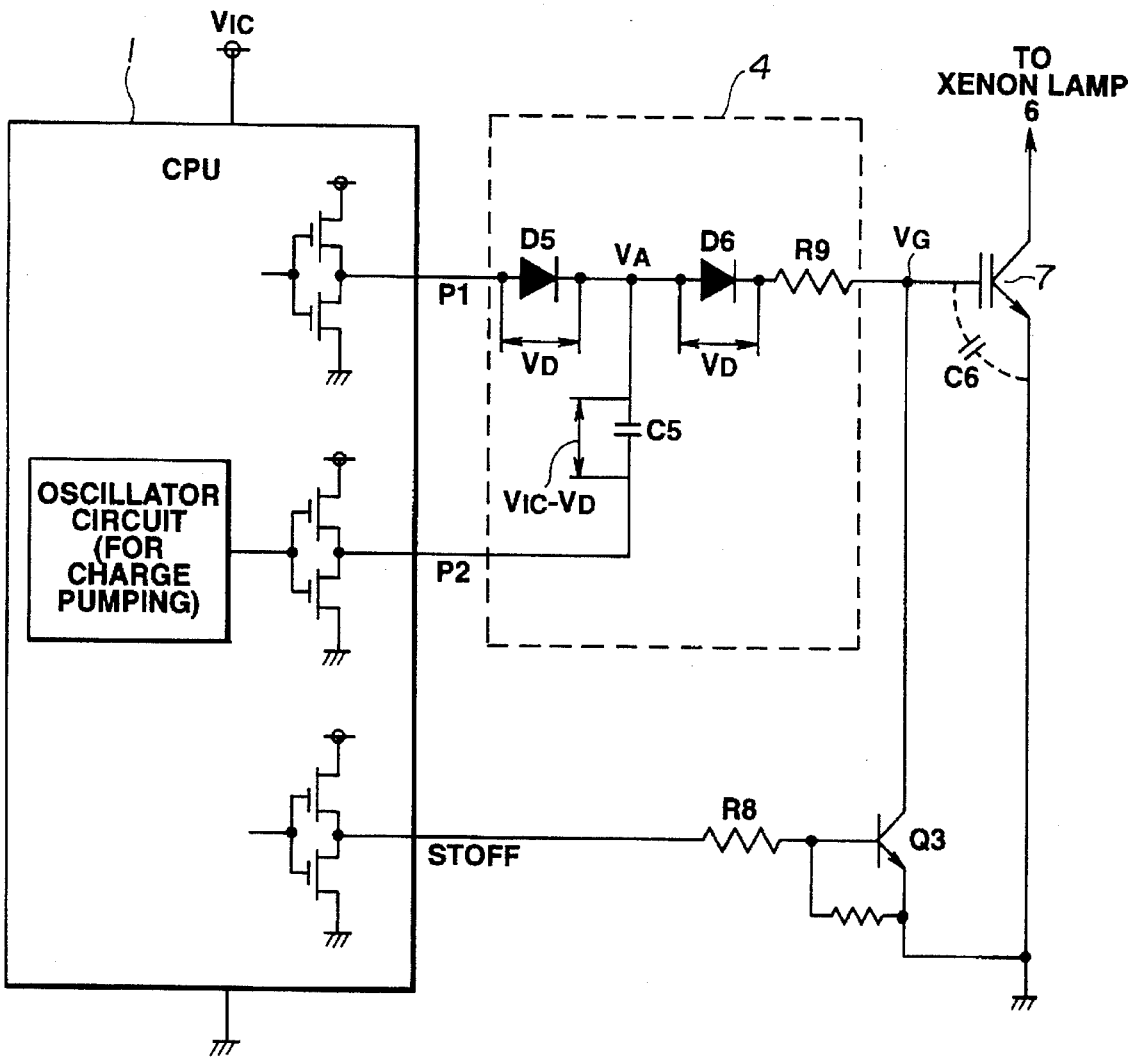
FIG. 5 is a schematic diagram showing in detail the step-up circuit of charge pump type (second constant voltage regulator circuit) of the first embodiment of the stroboscopic instrument.
Figure 6:
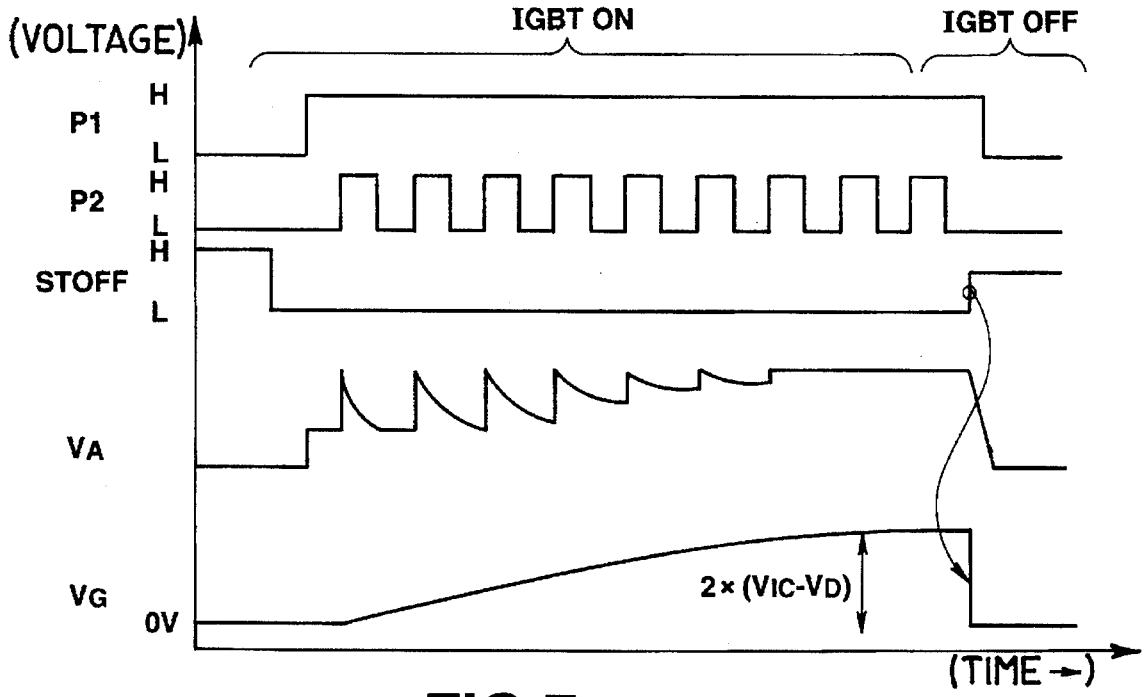
FIG. 6 is a waveform diagram showing signals in the second constant voltage regulator and its associated circuit of the first embodiment of the stroboscopic instrument.

FIG. 5 is a schematic diagram showing the charge-pump type voltage step-up circuit (second constant voltage regulator 4) and circuitry associated therewith of this embodiment. FIG. 6 is the waveform diagram showing signals in the second constant voltage regulator circuit 4 and its associated circuitry.

As was already described hereinabove, CPU 1 is supplied with the output voltage VIC from the first constant voltage regulator circuit 3. The output terminal P 1 of CPU 1 is connected to the anode of a diode D 5. The cathode of the diode D 5 is connected to both a capacitor C 5 and the anode of a diode D 6. The other electrode of the capacitor C 5 is connected to the output terminal P 2 of CPU 1. The cathode of the diode D 6 is connected via a resistor R 9 to both the gate electrode of IGBT 7 and the collector of a transistor Q 3. The base of the transistor Q 3 is connected via a resistor R 8 to the STOFF terminal of CPU 1. Let VG represent the gate voltage of IGBT 7, VB represent the anode voltage of the diode D 6, and VD represent the voltage across each of the diodes D 5 and D 6.

Assuming that the output signals at the terminals P 1, P 2, and STOFF on CPU 1 are P 1=L, P 2=L, and STOFF=H, the gate of IGBT 7 is shorted to GND. Now the signal STOFF is set to L, P 1 to H, and the signal at P 2 is oscillated; namely, with P 2=L, the capacitor C 5 is charged via the diode D 5 by a voltage (VIC−VD); with P 2=H, a stray capacitance C 6 of the gate of IGBT 7 is charged by a voltage VB via the diode D 6 and the resistor R 9 where VB is $$VB=VIC+(VIC-VD)$$

The capacitor C 5 is charged at each cycle, and may be small in capacitance relative to the stray capacitance C 6.

Assuming that VIC=3.5 volts, VD=0.5 volts, $$\begin{aligned} VG &= VB - VD = VIC + (VIC - VD) - VD = 2 \times (VIC - VD) \\ &= 2 \times (3.5 - 0.5) = 6 \text{ volts} \end{aligned}$$

Thus, the gate voltage of IGBT 7 is 6 volts.

To turn off the gate of IGBT 7, the STOFF terminal of CPU 1 is driven to H level, causing the transistor Q3 to be conductive.

To keep constant the voltage of the gate of IGBT 7, a zener diode has occasionally been used in the prior art. In this embodiment, if the regulated voltage VIC remains constant, no zener diode is required.

Figure 7:
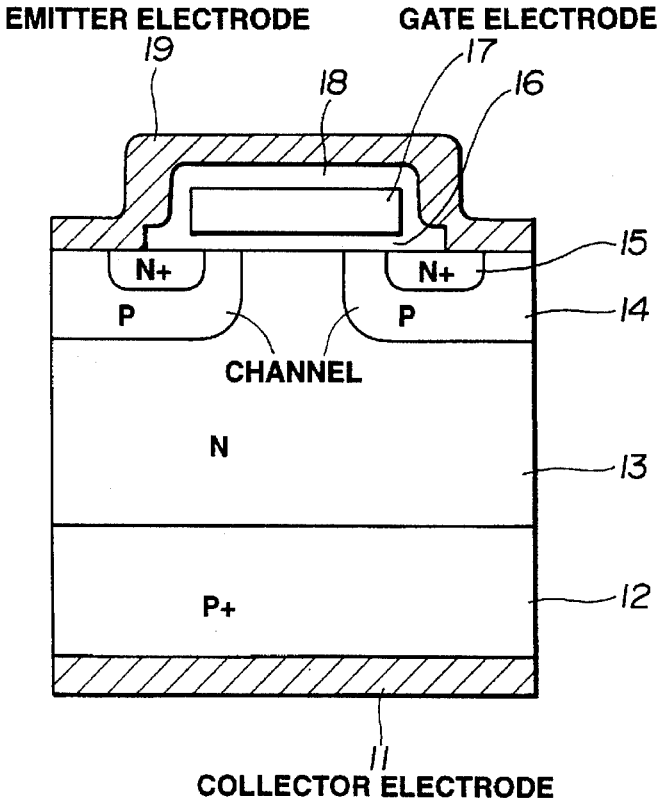
FIG. 7 is a cross-sectional view showing an example of the IGBT employed in the first embodiment of the stroboscopic instrument.

FIG. 7 is a cross-sectional view showing an example of IGBT incorporated in the embodiment. As shown in FIG. 7, a P layer 12 and an N layer 13 are formed on top of a collector electrode 11. Formed on top of the N layer 13 are successively a P layer 14 having an impurity lower than that of the P layer 12 and an N layer 15 having an impurity higher than that of the N layer 13. The surfaces of the P layer 14 that is enclosed by the N layer 13 and the N layer 15 constitute channel regions.

A gate electrode 17 is formed on the channel regions with a gate oxide film 16 therebetween. An emitter electrode 19 is formed on the gate electrode 17 with an insulating film 18 therebetween.

When a positive voltage is applied to the gate electrode 17 relative to the emitter electrode in the IGBT 7 constructed above, the above described channels are formed, causing a current to flow between the collector and the emitter. Voltage requirements for the gate are typically 10 to 14 volts. Implementing thin film technique in the gate oxide film 16 and microminiaturization technique in design allows one to develop an IGBT which allows a sufficient current to flow between collector and emitter even with a gate voltage of 4 volts.

Figure 8:
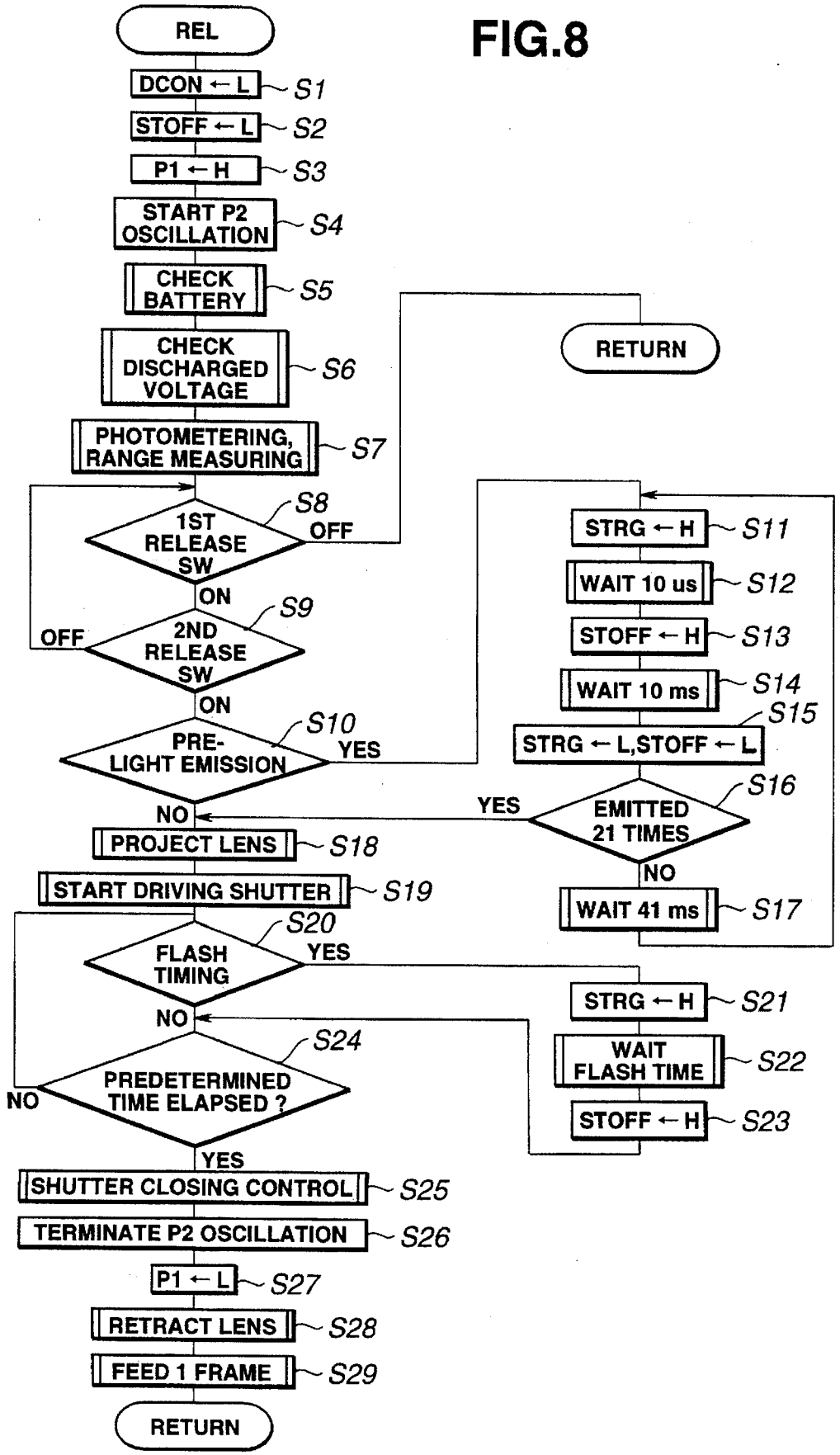
FIG. 8 is a flow diagram showing the operation of the first embodiment of the stroboscopic instrument.
Figure 9:
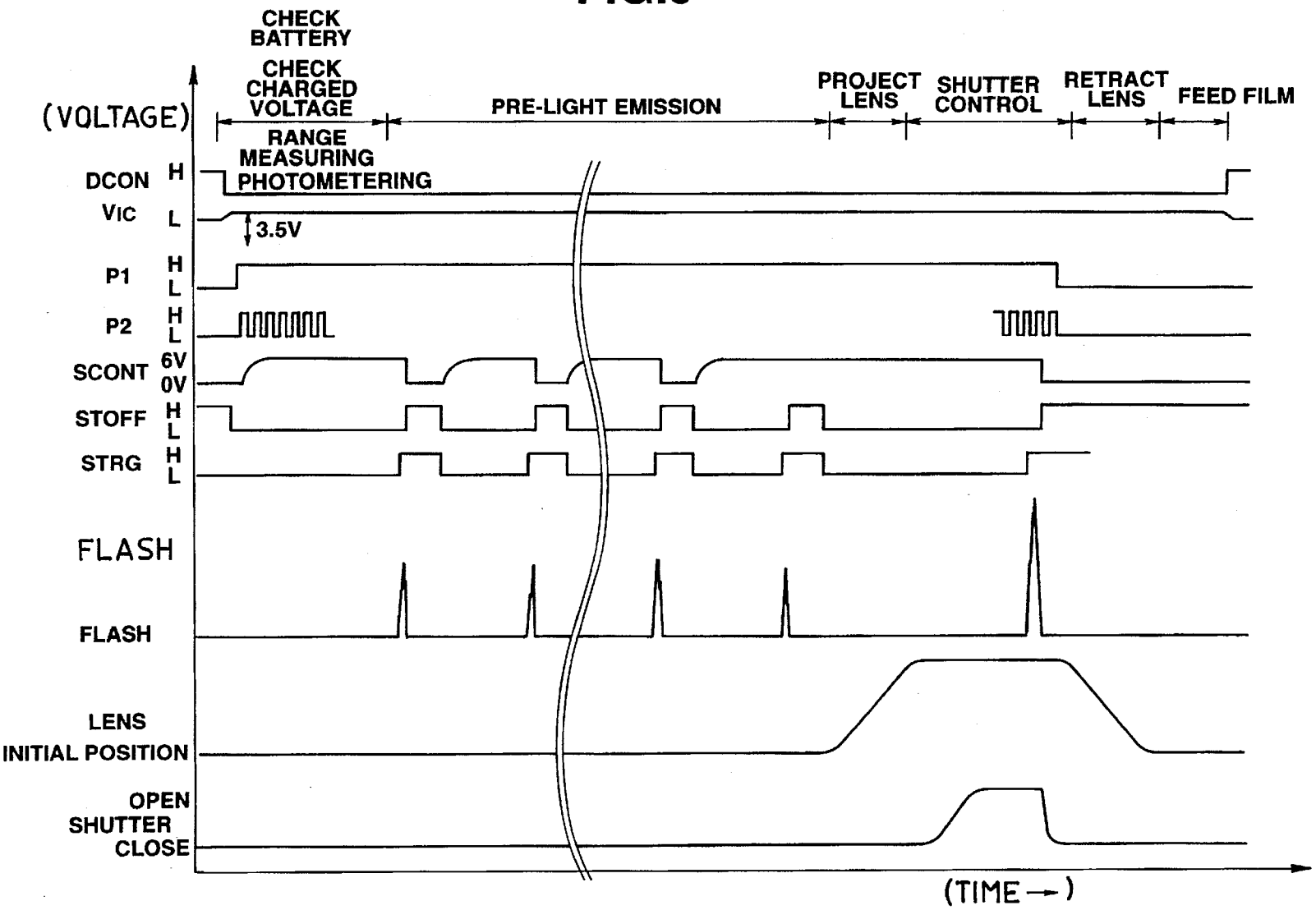
FIG. 9 is a timing diagram showing the operation of the first embodiment of the stroboscopic instrument.

FIG. 8 is a flow diagram showing the operation of the stroboscopic instrument of the first embodiment. FIG. 9 is the timing diagram showing the operation of the stroboscopic instrument.

Both the flow diagram and the timing diagram show the operation onward from the moment a first release SW is set to on.

At step S 1, the signal DCON from CPU 1 (FIG. 3) is driven to L level, the operation of the comparator OP 2 is initiated, starting stepping up the supply voltage for IC 10 such as CPU 1 (FIG. 4). The signal STOFF is set to L level at step S 2, P 1 is set to H level at step S 3, and the oscillation of P 2 is initiated at step S4. As a result, the output SCONT of the charge-pump type step-up circuit (second constant voltage regulator circuit 4) is stepped up, and the gate of IGBT 7 is activated.

In succession, the battery 2 is monitored at step S 5, the charged voltage at the main capacitor 5 is monitored at step S 6, and both photometering and ranging are performed at step S 7.

At steps S 8 and S 9, the program awaits until the first release switch and second release switch are on. When the second release switch is on, a determination is made of whether or not the pre-light emission for reducing red-eye phenomenon is required at step S 10. If it is required, 10 cycles of light emission (hereinafter referred to as pre-light emission) approximately as strong as Guide No. 1 are performed prior to an exposure.

At step S 11, the signal STRG is set to H level, triggering the flashing. The program waits for 10 μs, and the signal STOFF is set to H level at step S 13. Thus, a 10 μs flashing has been performed. In this embodiment, 10 μs flashing is approximately as strong as Guide No. 1. Depending on the types of the xenon lamp 6 and the main capacitor 5, however, the flashing time needs adjusting.

After a duration of 1 ms is allowed for the xenon lamp 6 to settle its ionization, the signals STRG and STOFF are set to L level at step S 15. When the determination at step S 16 reveals that 21 cycles of emission have not yet been completed, a next flashing is performed after a waiting time of 41 ms at step S 17.

At step S 18, the lens is projected. At step S 19, shutter driving is initiated. When it is a flash timing at step S 20, the signal STRG is set to H at step S 21 to initiate a flashing. After the flash time, the signal STOFF is set to H, ending the flashing. When the stroboscopic flashing operation is not needed, no flash timing is provided and no flashing is performed.

When the determination at step S 24 reveals that a shutter opening time has elapsed, the shutter closing control is performed at step S 25. At step S 26, oscillation of the signal output at the terminal P 2 is stopped. The signal at the terminal P 1 is set to L level at step S 27, the lens is retracted at step S 28, and the film is advanced by one frame at step S 29. This completes a series of exposure sequence.

According to the first embodiment of the stroboscopic instrument, as described above, the low-voltage gate driving IGBT is used to perform flashing control without the need for a complicated circuit and a high-voltage switching element.

The stroboscopic instrument also offers the following advantages: current requirements imposed on the built-in battery are reduced; and the voltage drop of the battery is minimized during charging of the main capacitor.

The second embodiment of the present invention is now discussed.

Figure 10:
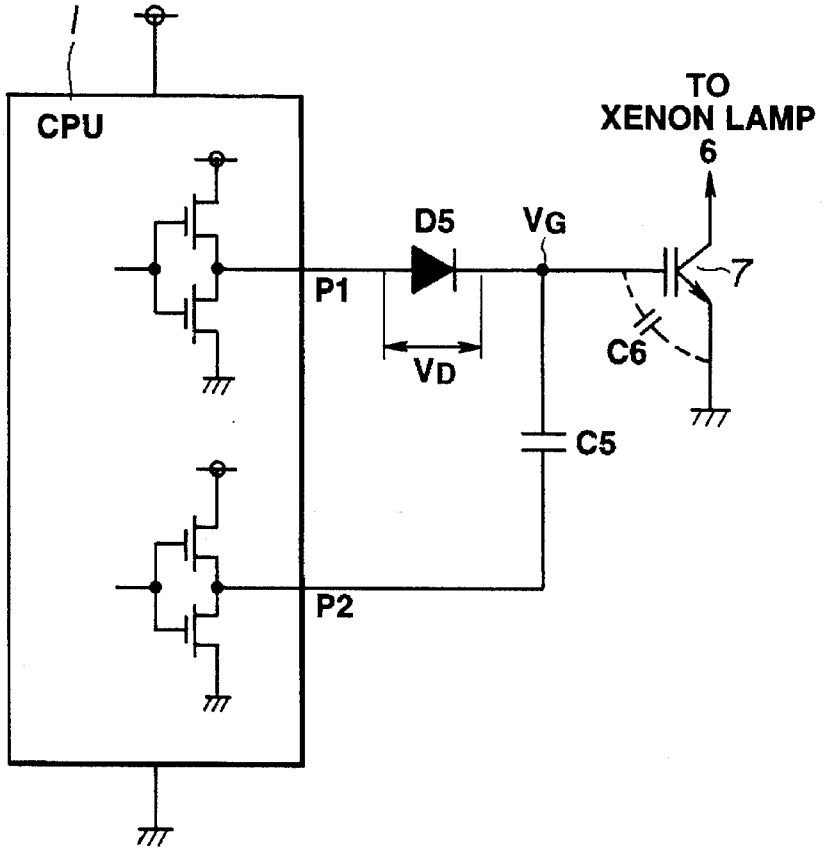
FIG. 10 is a schematic diagram showing the step-up circuit and circuitry associated therewith in a second embodiment of the stroboscopic instrument according to the present invention.
Figure 11:
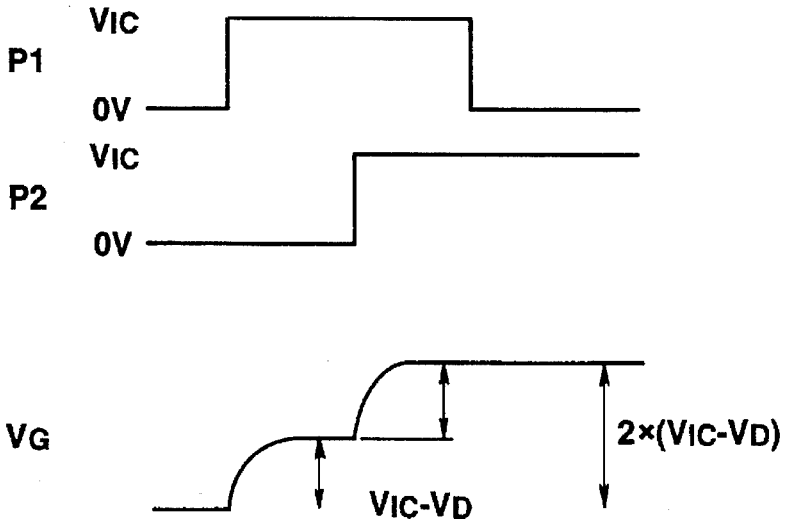
FIG. 11 is a waveform diagram showing signals in the step-up circuit and circuitry associated therewith in the second embodiment of the stroboscopic instrument.

FIG. 10 is a schematic diagram showing the step-up circuit and associated circuitry of the second embodiment of the stroboscopic instrument according to the present invention. FIG. 11 is a waveform diagram showing signals in the step-up circuit and associated circuitry. In FIGS. 10 and 11, those components equivalent to those described with reference to the preceding figures are designated with the same reference numerals, and their description will not be repeated.

In contrast to the second constant voltage regulator circuit 4 in the first embodiment, the second embodiment is characterized in that the terminal P 2 of CPU 1 is not connected to the oscillator circuit. The rest of the arrangement remains unchanged from that in the first embodiment.

As shown in FIG. 11, the initial condition of P 1=L and P 2=L is transitioned to P 1=H. Then, P 2 is set to H level after the capacitor C 5 has been fully charged. The gate voltage VG of IGBT 7 is then, $$VG=2\times(VIC-VD)$$

The second embodiment needs no such a diode as the diode 6 between the diode 5 and the gate of IGBT 7 in the first embodiment. Although the second embodiment has a simpler arrangement, it offers the same advantages as those of the first embodiment.

The third embodiment of the present invention is now discussed.

Figure 12:
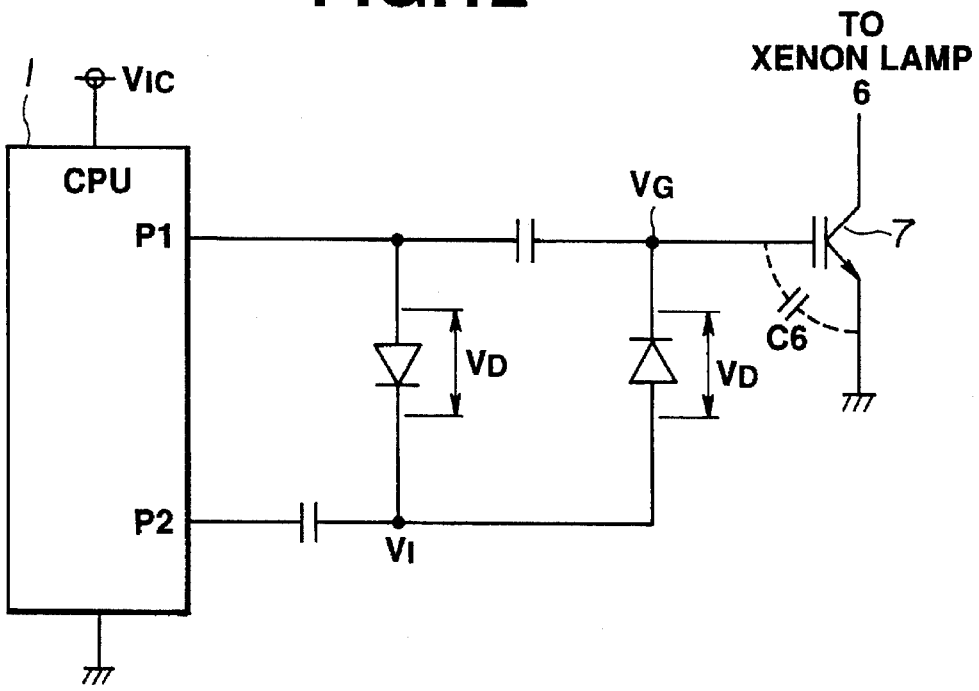
FIG. 12 is a schematic diagram showing the step-up circuit and circuitry associated therewith of a third embodiment of the stroboscopic instrument according to the present invention.
Figure 13:
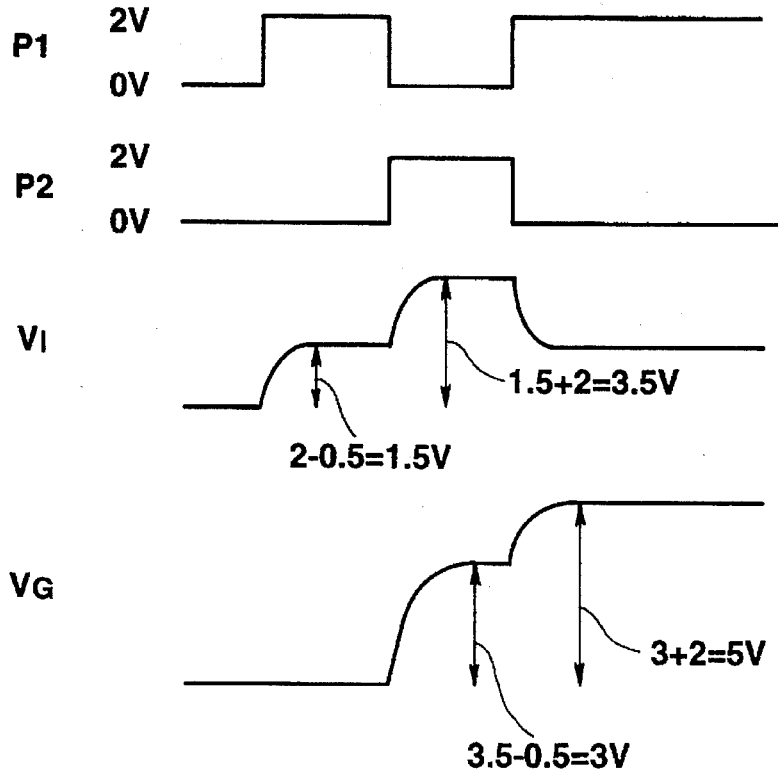
FIG. 13 is a waveform diagram showing signals in the step-up circuit and circuitry associated therewith of the third embodiment of the stroboscopic instrument.

FIG. 12 is a schematic diagram showing the step-up circuit and its associated circuit of the third embodiment of the stroboscopic instrument according to the present invention. FIG. 13 is a waveform diagram showing signals in the step-up circuit and associated circuitry. In these figures, those components equivalent to those with reference to the figures of the first embodiment are designated with the same reference numerals and their description will not be repeated.

In the first and second embodiments, the gate voltage VG of IGBT 7 is approximately twice as large as the regulated voltage VIC. In the third embodiment, the gate voltage VG is three times as large as the regulated voltage VIC as follows.

$$VG=3\times VIC-2\times VD$$

The rest of the arrangement of the third embodiment remains unchanged from the first embodiment.

Compared with the first and second embodiments, the third embodiment works with a low voltage battery. This can afford one a wider choice in the selection of IGBT 7, and offer easy-to-design and reduced cost advantages.

In the third embodiment, the ratio of voltages is approximately 3 times. Alternatively, the gate voltage VG may be an arbitrary integer multiple of the regulated voltage VIC, for example, it may be 4 times or 5 times the regulated voltage VIC. In such a case, the advantages already mentioned are even more noticeable.

The fourth embodiment of the present invention is now discussed.

Figure 14:
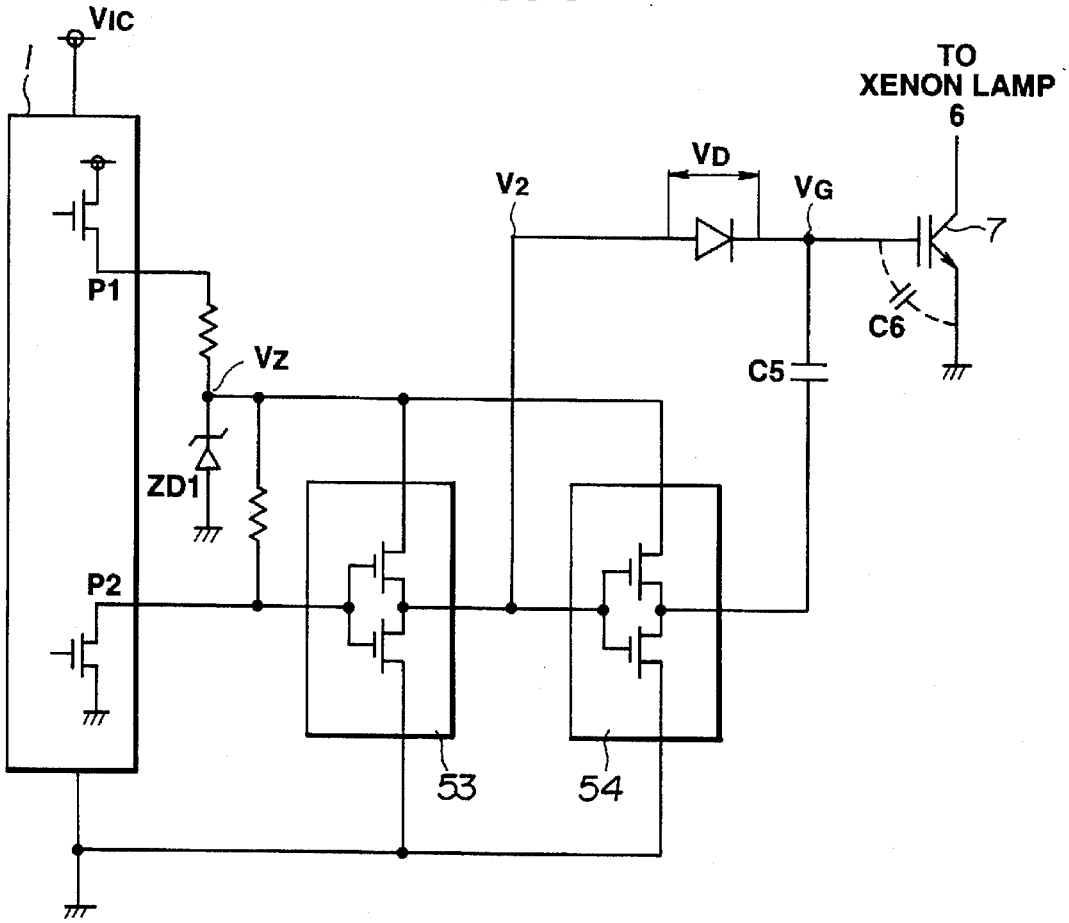
FIG. 14 is a schematic diagram showing the step-up circuit and circuitry associated therewith of a fourth embodiment of the stroboscopic instrument according to the present invention.
Figure 15:
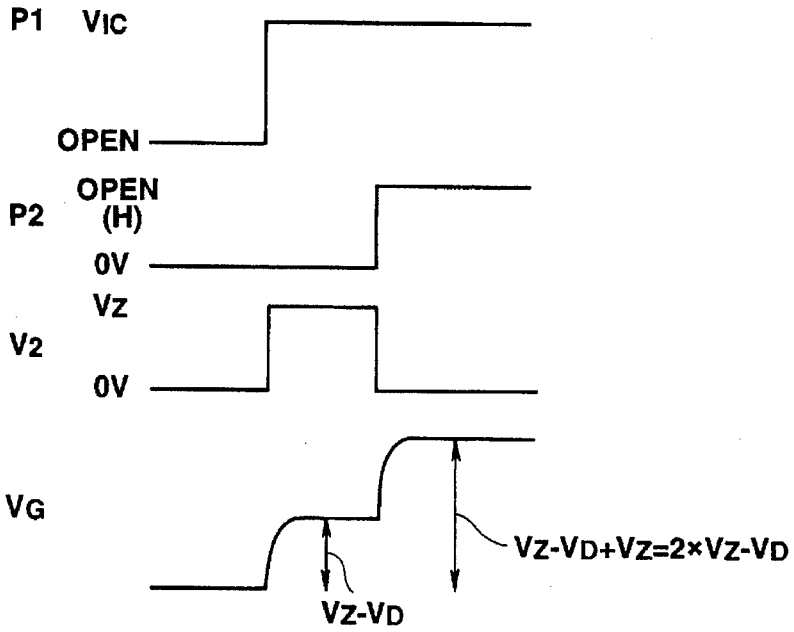
FIG. 15 is a waveform diagram showing signals in the step-up circuit and circuitry associated therewith of the fourth embodiment of the stroboscopic instrument.

FIG. 14 is the schematic diagram showing the step-up circuit and its associated circuit of the fourth embodiment of the stroboscopic instrument according to the present invention. FIG. 15 is the waveform diagram showing signals in the step-up circuit and its associated circuit. In these figures, those components equivalent to those with reference to the figures of the first embodiment are designated with the same reference numerals and their description will not be repeated.

The fourth embodiment is incorporated in a system in which CPU itself is not voltage regulated. The rest of the arrangement remains unchanged from the first embodiment.

As shown, a regulated voltage VZ that is provided from a zener diode ZD 1 is fed to CMOS inverter circuits 53, 54. The output signal from the terminal P 1 of CPU 1 causes the inverter circuits 53 and 54 to be conductive, and the transition of the output signal at the terminal P 2 from L level to open state (H level) causes the gate voltage VG of IGBT 7 to be as follows.

$$VG=2\times VZ-VD$$

The fourth embodiment of the stroboscopic instrument is particularly useful in the system where CPU itself is not voltage regulated. Thus, the fourth embodiment affords one a reduced cost and a greater design flexibility.

The fifth embodiment of the present invention is now discussed.

Figure 16:
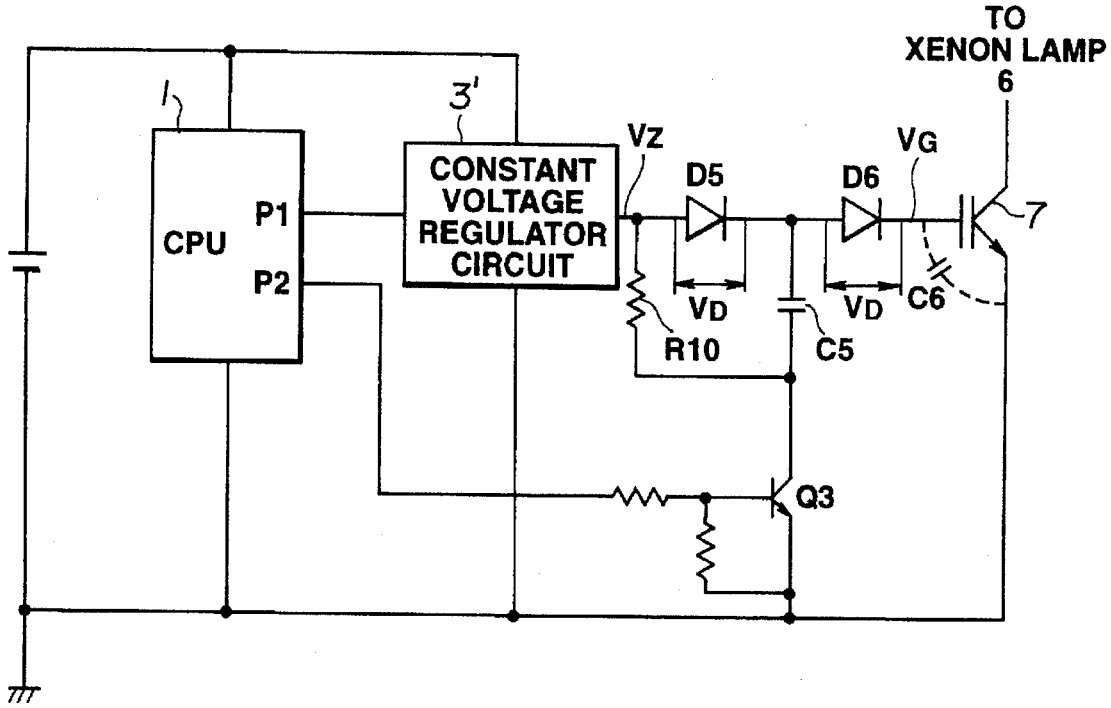
FIG. 16 is a schematic diagram showing the step-up circuit and circuitry associated therewith of a fifth embodiment of the stroboscopic instrument according to the present invention.
Figure 17:
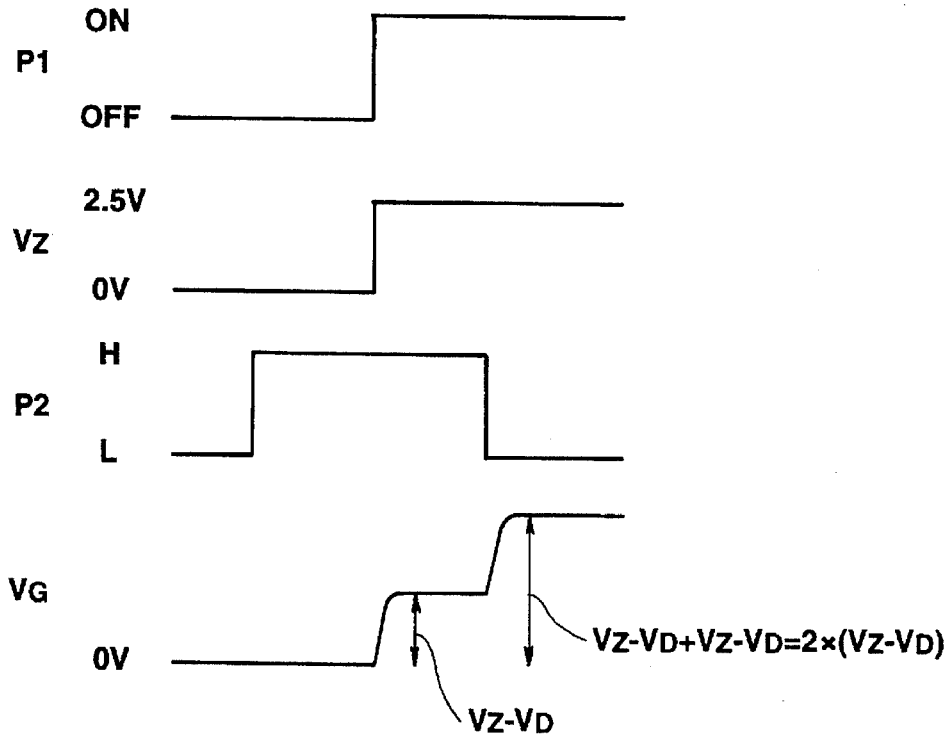
FIG. 17 is a waveform diagram showing signals in the step-up circuit and circuitry associated therewith of the fifth embodiment of the stroboscopic instrument.

FIG. 16 is a schematic diagram showing the step-up circuit and its associated circuit of the fifth embodiment of the stroboscopic instrument according to the present invention. FIG. 17 is a waveform diagram showing signals in the step-up circuit and its associated circuit. In these figures, those components equivalent to those with reference to the figures of the first embodiment are designated with the same reference numerals and their description will not be repeated.

The fifth embodiment is characterized in that the first constant voltage regulator circuit 3 in the first embodiment operates under the control of CPU 1. The rest of the arrangement remains unchanged from that of the first embodiment.

The transistor Q 3 is rendered conductive by driving the output signal at the terminal P 2 of CPU 1 to H level. The output signal from the terminal P 1 causes the constant voltage regulator circuit 3' to operate. With the capacitor C 5 charged, the transition of the output signal from the terminal P 2 to L level cuts off the transistor Q 3, charging the gate voltage VG (=2×(VZ−VD)) at the gate of IGTB.

The sixth embodiment of the present invention is now discussed.

Figure 18:
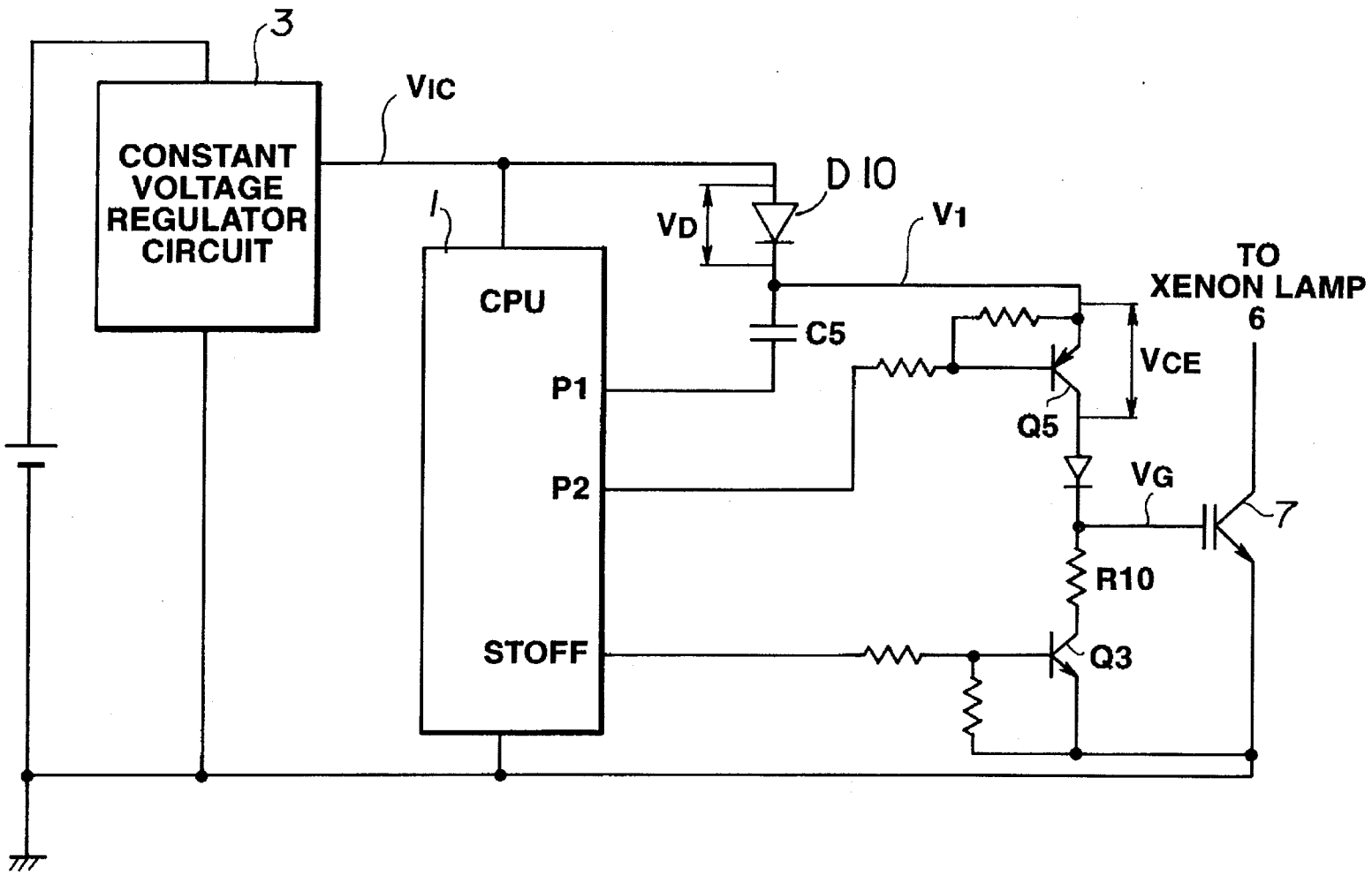
FIG. 18 is a schematic diagram showing the step-up circuit and circuitry associated therewith of a sixth embodiment of the stroboscopic instrument according to the present invention.

FIG. 18 is a schematic diagram showing the step-up circuit and its associated circuit of the sixth embodiment of the stroboscopic instrument according to the present invention. In FIG. 18, those components equivalent to those with reference to the figures of the first embodiment are designated with the same reference numerals and their description will not be repeated.

The sixth embodiment is characterized in that the anode of the diode D 10 for charge pumping is connected to the first constant voltage regulator circuit 3 and that the cathode of the diode D 10 is connected to the terminal P 1 of CPU 1 via the capacitor C 5.

When the output signal at the terminal P 1 on CPU 1 is transitioned to L level, the capacitor C 5 is charged. Then, with the output signal at the terminal P 1 driven to H level, the cathode voltage V1 of the diode D 10 is $$V1=VIC+(VIC-VD)$$

The output signal at the terminal P 2 of CPU 1 renders a PNP transistor Q5 conductive, and the gate voltage of IGBT 7 quickly reaches a voltage VG as follows.

$$VG=V1-VCE-VD=2\times(VIC-VD)-VCE$$

Then, IGBT 7 is switched on.

The gate of IGBT 7 is connected to an NPN transistor Q 3 via a resistor R 10. When the output signal at the STOFF terminal of CPU 1 causes the transistor Q 3 to conduct, IGBT 7 is turned off.

In the first through sixth embodiments, an IGBT is employed as the gate-controlled switching element. The gate-controlled switching element is not limited to an IGBT. Other switching element types described below may be employed.

FIG. 19A through FIG. 23B show several gate-controlled switching elements that may be incorporated into each of the above embodiments.

Figure 19A:
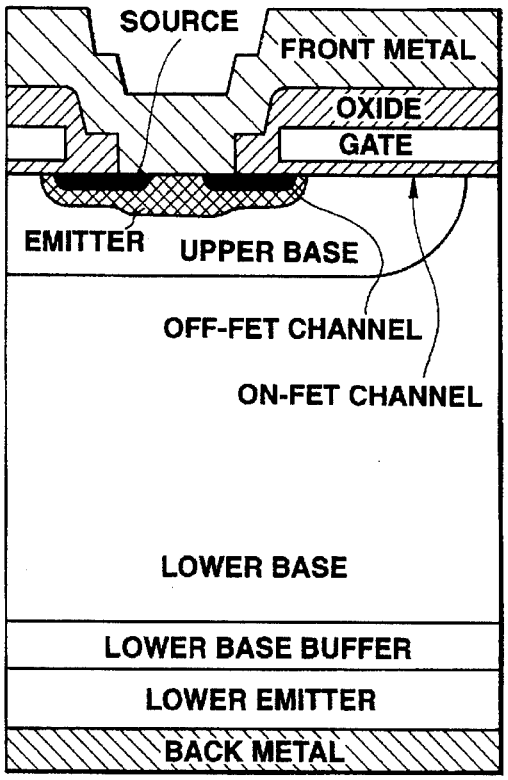
FIG. 19A is an enlarged cross-sectional view showing the major portion of, as an example of the gate-controlled switching element, an MCT (MOS Controlled Thyristor) that is incorporated into each of the above embodiments of the stroboscopic instrument.
Figure 19B:
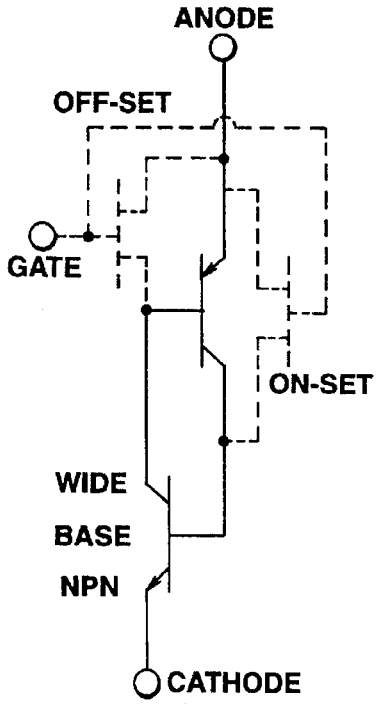
FIG. 19B is an equivalent circuit showing the interior of the MCT of FIG. 19A.

FIG. 19A is an enlarged cross-sectional view showing the major portion of, as an example of the gate-controlled switching element, an MCT (MOS Controlled Thyristor) that is incorporated into each of the above embodiments of the stroboscopic instrument. FIG. 19B is an equivalent circuit showing the interior of the MCT of FIG. 19A.

Figure 20A:
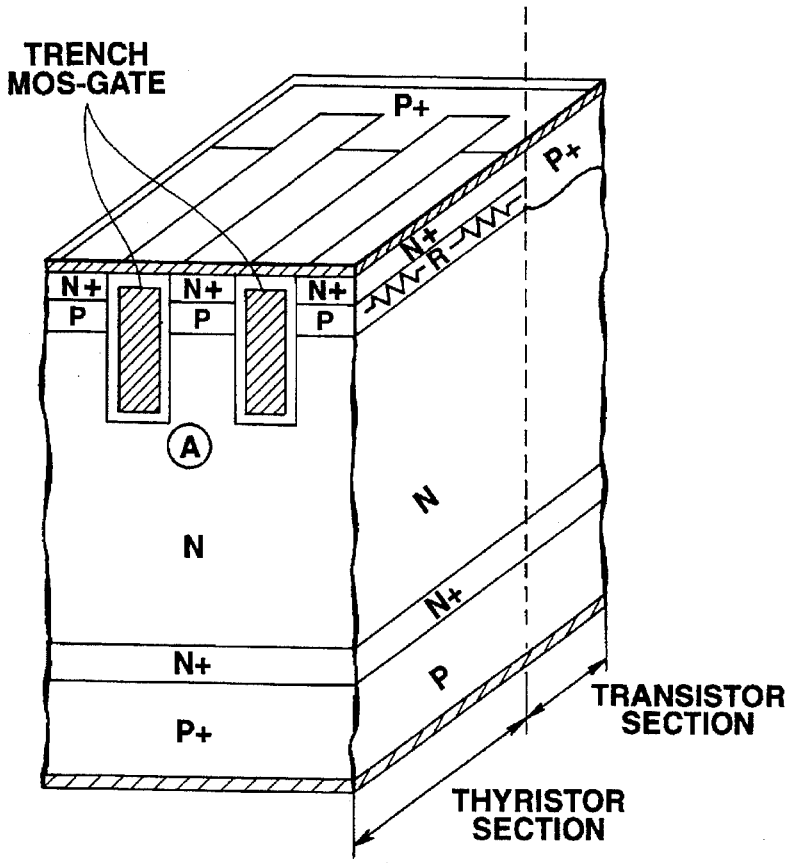
FIG. 20A is an enlarged perspective view showing, the major portion of, as an example of the gate-controlled switching element, a DMT (Depletion Mode Thyristor) that is incorporated into each of the above embodiments of the stroboscopic instrument.
Figure 20B:
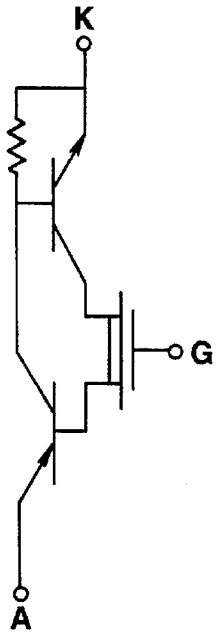
FIG. 20B is an equivalent circuit showing the interior of the DMT of FIG. 20A.

FIG. 20A is an enlarged perspective view showing, the major portion of, as an example of the gate-controlled switching element, a DMT (Depletion Mode Thyristor) that is incorporated into each of the above embodiments of the stroboscopic instrument. FIG. 20B is an equivalent circuit showing the interior of the DMT of FIG. 20A.

Figure 21A:
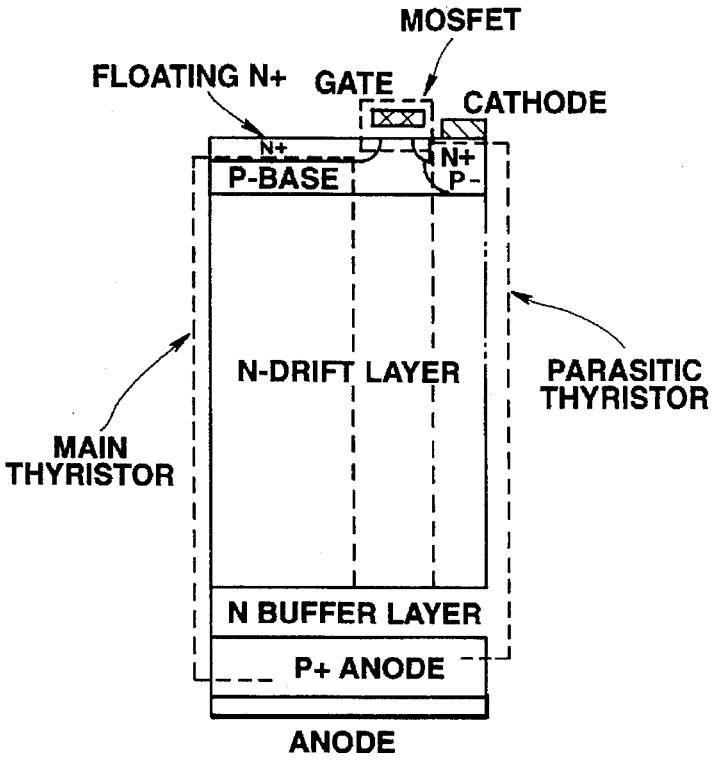
FIG. 21A is an enlarged cross-sectional view showing the major portion of, as an example of the gate-controlled switching element, an EST (Emitter Switched Thyristor) that is incorporated into each of the above embodiments of the stroboscopic instrument.
Figure 21B:
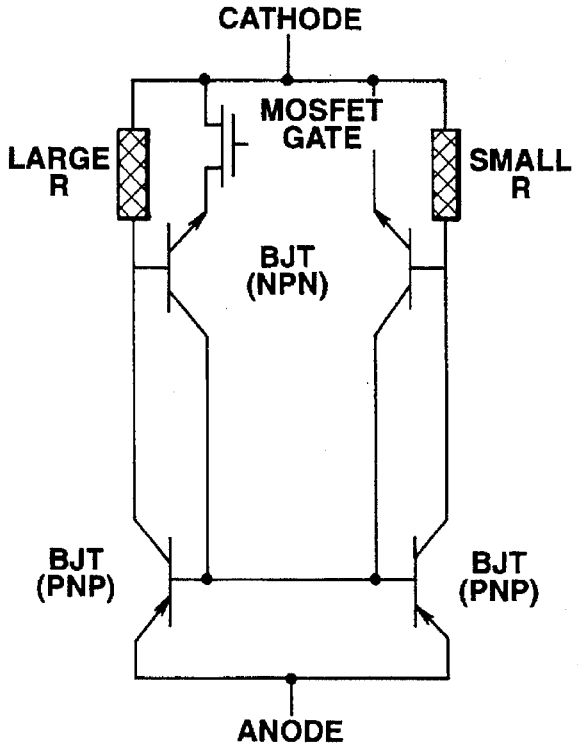
FIG. 21B is an equivalent circuit showing the interior of the EST of FIG. 21A.

FIG. 21A is an enlarged cross-sectional view showing the major portion of, as an example of the gate-controlled switching element, an EST (Emitter Switched Thyristor) that is incorporated into each of the above embodiments of the stroboscopic instrument. FIG. 21B is an equivalent circuit showing the interior of the EST of FIG. 21A.

Figure 22A:
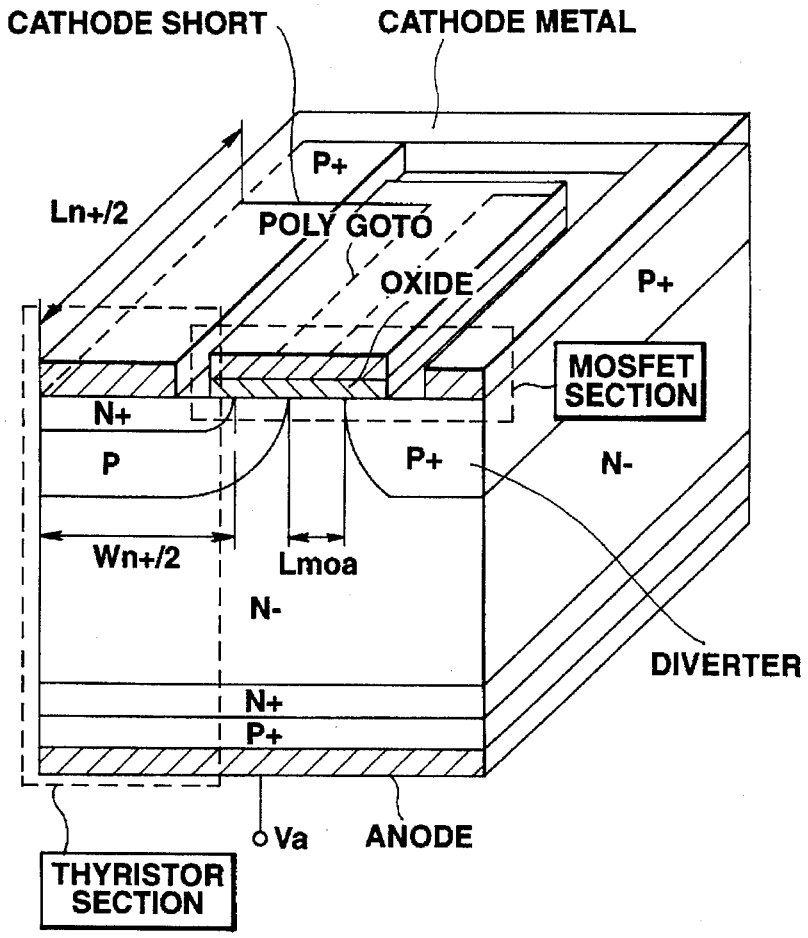
FIG. 22A is an enlarged perspective view showing, the major portion of, as an example of the gate-controlled switching element, a BRT (Base Resistance Controlled Thyristor) that is incorporated into each of the above embodiments of the stroboscopic instrument.
Figure 22B:
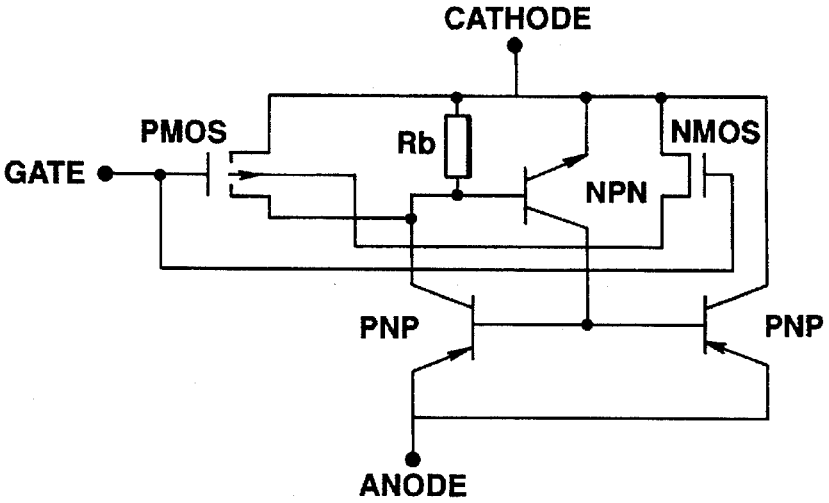
FIG. 22B is an equivalent circuit showing the interior of the BRT of FIG. 22A.

FIG. 22A is an enlarged perspective view showing, the major portion of, as an example of the gate-controlled switching element, a BRT (Base Resistance Controlled Thyristor) that is incorporated into each of the above embodiments of the stroboscopic instrument. FIG. 22B is an equivalent circuit showing the interior of the BRT of FIG. 22A.

Figure 23A:
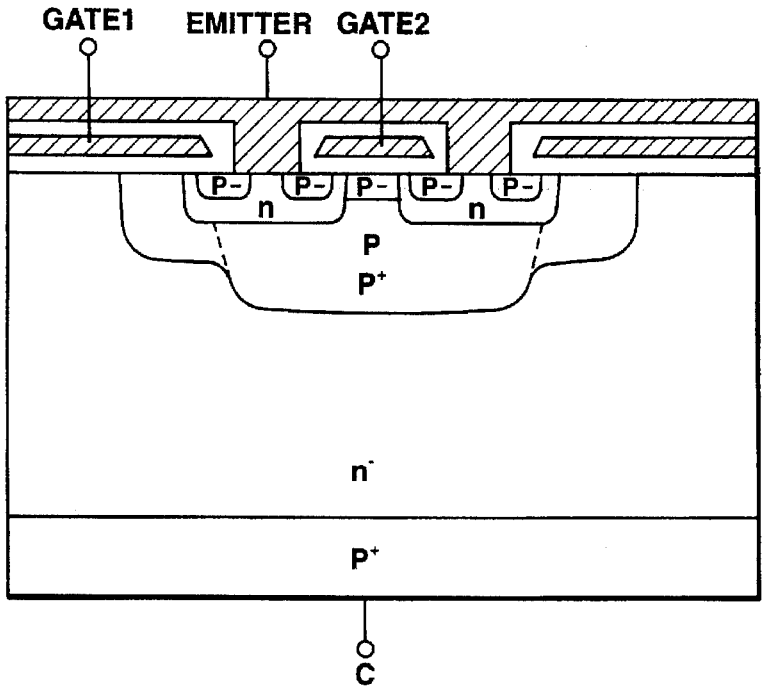
FIG. 23A is an enlarged perspective view showing, the major portion of, as an example of the gate-controlled switching element, a DGMOS (Double Gate MOS Device) that is incorporated into each of the above embodiments of the stroboscopic instrument.
Figure 23B:
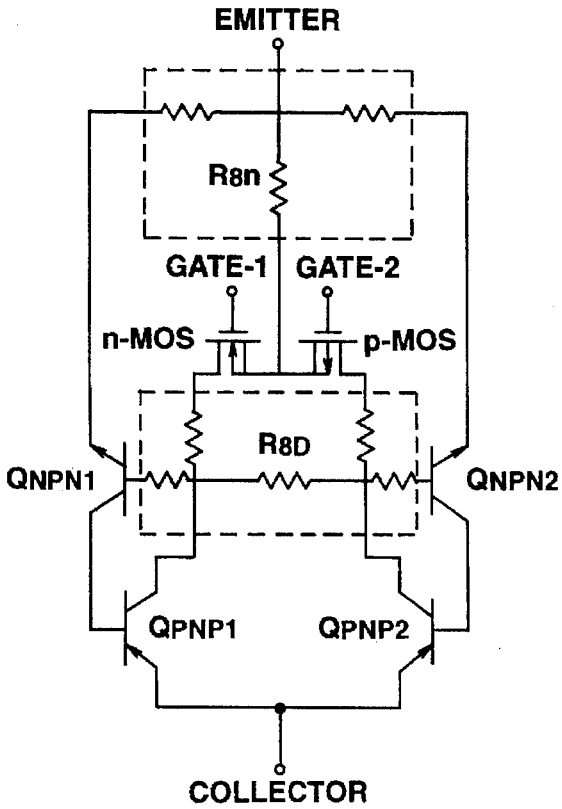
FIG. 23B is an equivalent circuit showing the interior of the DGMOS of FIG. 23A.

FIG. 23A is an enlarged perspective view showing, the major portion of, as an example of the gate-controlled switching element, a DGMOS (Double Gate MOS Device) that is incorporated into each of the above embodiments of the stroboscopic instrument. FIG. 23B is an equivalent circuit showing the interior of the DGMOS of FIG. 23A.

According to the above-described embodiments, the low-voltage gate driving IGBT can control flashing without the need for a complicated circuit and a high-voltage switching element.

In this invention, it is apparent that working modes different in a wide range can be formed on this basis of the invention without departing from the spirit and scope of the invention. This invention is not restricted by any specific embodiment except as may be limited by the appended claims.

What is claimed is:

1. A stroboscopic instrument having a gate-controlled switching element connected in series with a discharge lamp and main capacitor for storing charge that causes the discharge lamp to flash, said stroboscopic instrument comprising:

stroboscopic flashing control means for controlling an operation of stroboscopic flashing;

a low-voltage power supply for providing an output voltage lower than driving voltages of the stroboscopic flashing control means and the gate-controlled switching element;

a first constant voltage regulator circuit for stepping up the output voltage of the low-voltage power supply to a driving voltage of a level for powering the stroboscopic flashing control means; and a second constant voltage regulator circuit, for stepping up one of an output voltage of the low-voltage power supply and an output voltage of the first constant voltage regulator circuit to a driving voltage of a level for turning on the gate-controlled switching element;

wherein said stroboscopic flashing control means includes means to control said gate-controlled switching element to operate in an on/off manner and to control the driving voltage provided to said gate-controlled switching element by said second constant voltage regulator circuit.

2. The stroboscopic instrument according to claim 1, wherein the output voltage of the first constant voltage regulator circuit is fed to the second constant voltage regulator circuit via the stroboscopic flashing control means.

3. The stroboscopic instrument according to claim 1, wherein the second constant voltage regulator circuit is a charge-pump type voltage step-up circuit.

4. A stroboscopic instrument according to claim 1, wherein the low-voltage power supply provides an output voltage of approximately 3 volts and the second constant voltage regulator circuit steps up the output voltage of the low-voltage power supply to a regulated gate voltage of approximately 10 volts or lower at which the gate-controlled switching element is operative.

5. The stroboscopic instrument according to claim 1, wherein the first output voltage from the first constant voltage regulator circuit is a driving voltage for the stroboscopic flashing control means, which in turn feeds the first output voltage to the second constant voltage regulator circuit, and the second output voltage from the second constant voltage regulator circuit is fed to the gate-controlled switching element.

6. A stroboscopic instrument comprising:

a main capacitor for storing charge that causes a discharge lamp to flash;

a gate-controlled switching element for forming a discharge loop that is connected in series with the main capacitor and the discharge lamp;

a low-voltage power supply for generating a voltage lower than a gate voltage sufficient for operating the gate-controlled switching element;

a first constant voltage regulator circuit for generating a regulated voltage based on the voltage from the low-voltage power supply;

stroboscope control means operating based on the output voltage from the first constant voltage regulator circuit;

a charging circuit for charging the main capacitor under the control of the stroboscope control means; and a second constant voltage regulator means for generating the gate voltage for the gate-controlled switching element by stepping up an output voltage from the stroboscope control means.

7. A stroboscopic instrument comprising:

a main capacitor for storing charge sufficient to cause a discharge lamp to flash;

a gate-controlled switching element which constitutes a discharge loop and is connected in series with the main capacitor and the discharge lamp and which is operative at a gate voltage of approximately 10 volts or lower;

a constant voltage regulator circuit for stepping up or down an output voltage in a range of 1.5 to 3.5 volts provided by a low-voltage power supply to a regulated voltage of approximately 3 volts;

stroboscope control means operating based on the output voltage from the constant voltage regulator circuit;

a charging circuit for charging the main capacitor by the output of the stroboscope control means; and a charge-pump type voltage step-up circuit for stepping up an output from the stroboscope control means to the gate voltage that controls the gate-controlled switching element.

8. A stroboscopic instrument comprising:

a main capacitor for storing charge that is sufficient to cause a discharge lamp to flash;

a gate-controlled switching element which constitutes a discharge loop and is connected in series with the main capacitor and the discharge lamp and which is operative at a gate voltage of approximately 10 volts or lower;

a constant voltage regulator circuit for stepping up or down an output voltage in a range of 1.5 to 3.5 volts provided by a low-voltage power supply to a regulated voltage of approximately 3 volts;

stroboscope control means operating based on the output voltage from the constant voltage regulator circuit for providing step-up voltage control; and a charge-pump type voltage step-up circuit for stepping up an output from the constant voltage regulator circuit to the gate voltage that controls the gate-controlled switching element based on the step-up voltage control.

9. The stroboscopic instrument according to any of claims 6, 7 and 8, wherein the gate-controlled switching element is an element taken from the group consisting of an IGBT, an MCT and an EFT.

10. A stroboscopic instrument having a gate-controlled switching element forming a discharge loop that is connected in a series with a discharge lamp and a main capacitor for storing charge that causes said discharge lamp to flash, said stroboscopic instrument comprising:

a low-voltage power supply that provides a voltage lower than a driving voltage of said gate-controlled switching element;

a first constant voltage regulator circuit for stepping up a voltage of said low-voltage power supply to a first constant voltage;

stroboscopic flashing control means for controlling at least a flashing operation of said discharge lamp, which is operated by said first constant voltage; and a second constant voltage regulator circuit, provided with a capacitor to which said first constant voltage from said first constant voltage regulator circuit is supplied as an input voltage for charging said capacitor, for stepping up a charging voltage of said capacitor to a predetermined second constant voltage based on an output of said stroboscopic flashing control means which also controls said gate-controlled switching element with said second constant voltage.

11. A stroboscopic instrument according to claim 10, wherein said second constant voltage is approximately an integer multiple of said first constant voltage.

* * * * *